US008411020B2

(12) United States Patent
Yeh

(10) Patent No.: US 8,411,020 B2
(45) Date of Patent: Apr. 2, 2013

(54) HYSTERESIS-TYPE CONTROLLING METHOD FOR BACKLIGHT OF PORTABLE ELECTRONIC DEVICE

(75) Inventor: Chris Yeh, Hsin-Tien (TW)

(73) Assignee: Unitech Electronics Co., Ltd., New Taipei (TW)

( * ) Notice: Subject to any disclaimer, the term of this patent is extended or adjusted under 35 U.S.C. 154(b) by 780 days.

(21) Appl. No.: 12/353,557

(22) Filed: Jan. 14, 2009

(65) Prior Publication Data

US 2010/0177029 A1 Jul. 15, 2010

(51) Int. Cl.
*G09G 3/36* (2006.01)

(52) U.S. Cl. ..... 345/102

(58) Field of Classification Search ..... None
See application file for complete search history.

(56) References Cited

U.S. PATENT DOCUMENTS 5,796,350 A * 8/1998 Fuse ..... 340/815.75
6,762,741 B2 * 7/2004 Weindorf ..... 345/102
7,027,113 B2 * 4/2006 Kim et al. ..... 349/63
7,796,143 B2 * 9/2010 Huang ..... 345/690
7,825,981 B2 * 11/2010 Iwane et al. ..... 348/342
8,040,341 B2 * 10/2011 Lin ..... 345/212

* cited by examiner

*Primary Examiner* — K. Wong

(74) *Attorney, Agent, or Firm* — Chun-Ming Shih; HDLS IPR Services

(57) ABSTRACT

A method for controlling backlight of portable electronic device in hysteresis manner pre-sets the portable electronic device in a default mode and senses a background brightness. The portable electronic device is operated at a daylight mode when the sensed background brightness is larger than a first threshold. When the portable electronic device is operated at the daylight mode and the sensed background brightness is smaller than a second threshold, the portable electronic device is again operated at the default mode, where the second threshold is much smaller then the first threshold to provide hysteresis effect. Therefore, the backlight can be turned off when the background brightness is sufficient. A rapid switch between default mode and daylight mode can be prevented by the hysteresis-manner control and user dizziness caused by rapid modes switch can also be prevented.

5 Claims, 3 Drawing Sheets

HYSTERESIS-TYPE CONTROLLING METHOD FOR BACKLIGHT OF PORTABLE ELECTRONIC DEVICE

BACKGROUND OF THE INVENTION

1. Field of the Invention

The present invention relates to a method controlling backlight of portable electronic device, especially to a method for controlling backlight of portable electronic device in hysteresis manner.

2. Description of Prior Art

Portable electronic devices such as mobile phone and personal digital assistants (PDAs) have enhanced function and gained popularity as technology keeps progressing. Moreover, user has more chance to watch the display of the portable electronic devices as the price of LCD display is reduced and LCD is omnipresent for portable electronic devices.

One of the major requirements for LCD screen used in portable electronic devices is adaptation for environment brightness because the portable electronic devices are usually used in mobile manner. The backlight of the LCD screen of the portable electronic devices needs adjustment for saving power and providing comfortable reading. When the environment brightness is intense, the backlight of the LCD screen of the portable electronic devices had better turn off and the reading illumination relies on light reflected from the LCD screen. When the environment brightness is not sufficient, user feel uncomfortable in reading the LCD screen if the backlight of the LCD screen of the portable electronic devices is much brighter than the environment brightness.

Depending on the position of light source, the LCD screen can be, for example, transmissive display or reflective display. The transmissive LCD screen uses a light source at back side thereof and user watches the LCD screen from the front side. The transmissive LCD screen is generally used for high-brightness application such as computer display. The reflective LCD screen uses light reflected from a reflecting face at back side thereof as light source, and is often used for electronic watches or PDA. Moreover, transreflective LCD screen can be used as transmissive display or reflective display. More particularly, the transreflective LCD screen is used as reflective display when environment brightness is ample, and the transreflective LCD screen is used as transmissive display when environment brightness is weak.

A prior art LCD screen with brightness adjustment mechanism is developed for adaptation to environment brightness. The brightness adjustment mechanism comprises a light sensor and a backlight adjustment unit. FIG. 1 shows a backlight adjustment curve for in the prior art LCD screen with brightness adjustment mechanism, where the LCD screen is a transreflective LCD screen. The environment brightness sensed by the light sensor is divided into three regions defined by thresholds C1 and C2, namely, the weak brightness region, the normal brightness region, and the high brightness region. The backlight adjustment unit adjusts the backlight brightness of the LCD screen with reference to the three regions defined by thresholds C1 and C2. However, the environment brightness may change at the vicinity for one of the thresholds C1 and C2 if the user is mobile. For example, when the LCD screen is for PDA used by a parking metering staff, the environment brightness may change as the staff is moving. As a result, the backlight brightness of the LCD screen changes rapidly as the staff is moving. This causes user's eye fatigue and frequent work of the backlight adjustment unit.

SUMMARY OF THE INVENTION

It is an object of the application to provide a method for controlling backlight of portable electronic device to prevent user dizziness caused by rapid modes switch.

Accordingly, the present invention provides a hysteresis-type backlight controlling method for a portable electronic device. The portable electronic device comprises a light sensor, a liquid crystal display (LCD) backlight drive and a keyboard backlight unit. The method pre-sets the portable electronic device in a default mode and senses a background brightness. The portable electronic device is operated at a daylight mode when the sensed background brightness is larger than a first threshold (such as 2000 lumens). When the portable electronic device is operated at the daylight mode and the sensed background brightness is smaller than a second threshold (such as 1000 lumens), the portable electronic device is again operated at the default mode, where the second threshold is much smaller then the first threshold to provide hysteresis effect. Therefore, the backlight can be turned off when the background brightness is sufficient. A rapid switch between default mode and daylight mode can be prevented by the hysteresis-manner control and user dizziness caused by rapid modes switch can also be prevented.

Moreover, the method further, at the default mode, sets the portable electronic device to operate at a nighttime mode when the sensed background brightness is smaller than a third threshold (such as 100 lumens). At the nighttime mode, the method sets the portable electronic device to operate at the default mode when the sensed background brightness is larger than a fourth threshold (such as 150 lumens); wherein the fourth threshold is larger than the third threshold. A rapid switch between default mode and nighttime mode can be prevented by the hysteresis-manner control and user dizziness caused by rapid modes switch can also be prevented.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Figure 1:
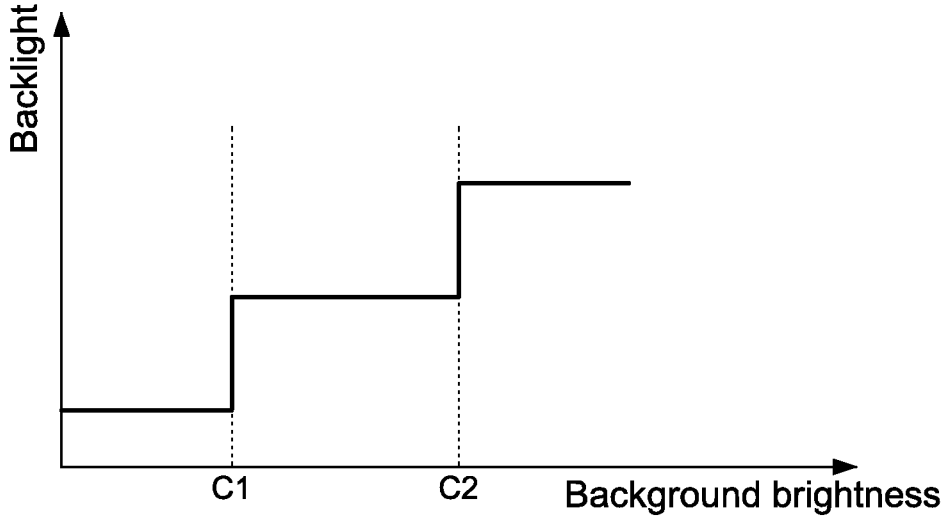
FIG.1 PRIOR ART
FIG. 1 shows a backlight adjustment curve for in the prior art LCD screen with brightness adjustment mechanism.
Figure 2:
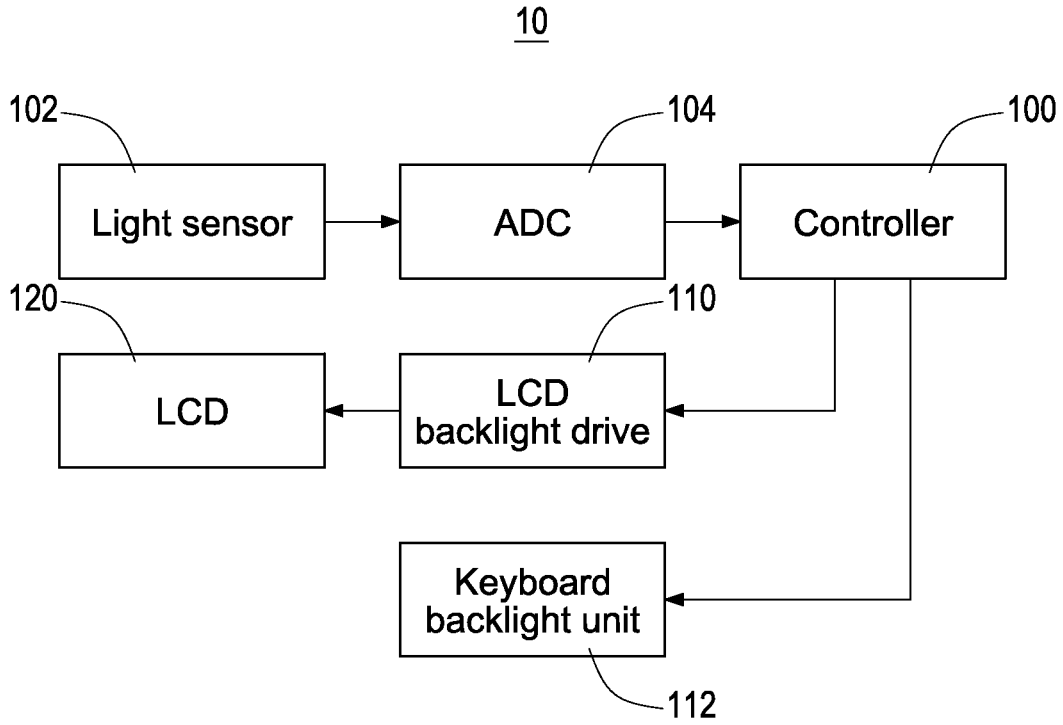
FIG. 2 shows the schematic view of the portable electronic device with the hysteresis-type backlight controlling method according to the present invention.

FIG. 2 shows the schematic view of the portable electronic device with the hysteresis-type backlight controlling method according to the present invention. The portable electronic device mainly comprises a controller 100, a light sensor 102, an analog to digital converter (ADC) 104, a liquid crystal display (LCD) backlight drive 110, a keyboard backlight unit 112 and an LCD 120.

The light sensor 102 senses a background brightness value and sends the background brightness to the ADC 104 for further processing. The ADC 104 converts the background brightness to a digital background brightness data and then sends the digital background brightness data to the controller 100 for further processing. The controller 100 is electrically connected to the LCD backlight drive 110 and the keyboard backlight unit 112, respectively. The controller 100 is adapted to control the LCD backlight drive 110 and the keyboard backlight unit 112 according to the digital background brightness data and the hysteresis-type backlight controlling method according to the present invention (detailed later), whereby the backlight of LCD and the backlight of the keyboard can be optimally controlled.

According to a preferred embodiment of the present invention, the LCD is a transreflective LCD such as Blanview LCD of Casio. However, the hysteresis-type backlight controlling method according to the present invention can be applied to other kinds of LCD.

Figure 3:
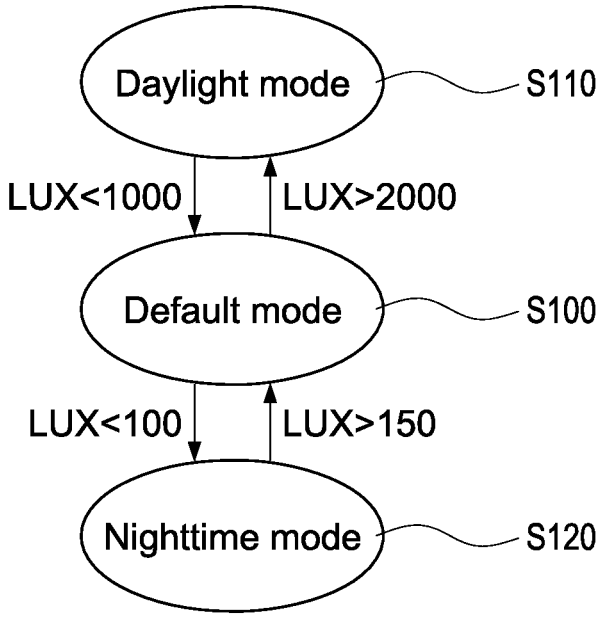
FIG. 3 shows the state diagram for the operation of the portable electronic device with the hysteresis-type backlight controlling method according to the present invention.

FIG. 3 shows the state diagram for the operation of the portable electronic device with the hysteresis-type backlight controlling method according to the present invention. Initially the portable electronic device is operated at a default mode (normal mode) (S100). When the background brightness is lager than a first threshold LUX1, the controller 100 sets the portable electronic device to operate at a daylight mode (S110), where in the daylight mode, the controller 100 controls the LCD backlight drive 110 and the keyboard backlight unit 112 to have minimal brightness, namely minimal illumination. More particularly, the minimal brightness can be zero brightness.

At daylight mode (S110), when the sensed background brightness is smaller than a second threshold LUX2, the controller 100 sets the portable electronic device 10 to operate at the default mode (S100) again, where in the default mode, the controller 100 controls the LCD backlight drive 110 and the keyboard backlight unit 112 to have default brightness, respectively. For example, the default brightness can be maximal brightness, or a default value set by user. Moreover, the second threshold LUX 2 is much smaller then the first threshold LUX1 to provide hysteresis effect. For example, the first threshold LUX1 is 2000 lumens (such as in sunshine environment) and the second threshold LUX2 is 1000 lumens. Therefore, the backlight can be advantageously turned down or set to be minimal value to reduce power consumption when the background brightness is ample. Moreover, the second threshold LUX2 has substantially difference with the first threshold LUX1 to provide hysteresis effect. The portable electronic device can be prevented from quick switch between default mode (S100) and daylight mode (S110), whereby user dizziness caused by rapid modes switch can also be prevented.

At default mode (S100), when the sensed background brightness is smaller than a third threshold LUX3, the controller 100 sets the portable electronic device 10 to operate at a nighttime mode (S120). At the nighttime mode (S120), the controller 100 controls the LCD backlight drive 110 and the keyboard backlight unit 112 to have relatively smaller brightness, respectively. For example, the relatively smaller brightness is 30% of the maximal brightness. Therefore, user can still clearly watch the portable electronic device 10 in dim environment. At the nighttime mode (S120), when the sensed background brightness is larger than a fourth threshold LUX4, the controller 100 sets the portable electronic device 10 to operate at the default mode (S100) again. Moreover, the third threshold LUX3 is smaller than the fourth threshold LUX4 to provide hysteresis effect. For example, the third threshold LUX3 is 100 lumens and the fourth threshold LUX4 is 150 lumens. Therefore, the portable electronic device can be prevented from quick switch between the default mode (S100) and the nighttime mode (S120), whereby user dizziness caused by rapid modes switch can also be prevented.

Figure 4:
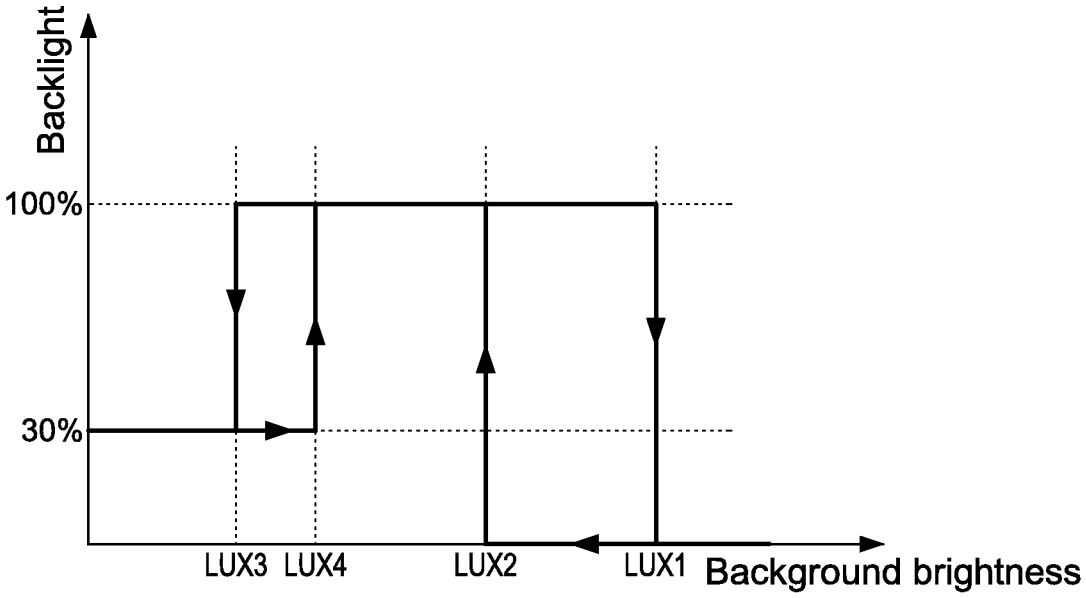
FIG. 4 shows the backlight adjustment curve for the portable electronic device with the hysteresis-type backlight controlling method according to the present invention.

FIG. 4 shows the backlight adjustment curve for the portable electronic device with the hysteresis-type backlight controlling method according to the present invention. As can be seen from the figure, at least one hysteresis loop (two hysteresis loops shown in this figure) is provided in the backlight adjustment curve, whereby rapid mode switch caused by background brightness change can be prevented and user dizziness caused by rapid modes switch can also be prevented. Moreover, according to one aspect of the present invention, user only needs to set up the default brightness for default mode (normal mode) while the brightness for daylight mode and nighttime mode are automatically set by the controller 100. Therefore, user can clearly watch the portable electronic device at daylight, normal brightness and nighttime environment without complicated setting task. The portable electronic device with the hysteresis-type backlight controlling method can be easily used by layman user with enhanced convenience.

What is claimed is:

1. A hysteresis-type backlight controlling method for a portable electronic device, the portable electronic device comprising a light sensor, a liquid crystal display (LCD) backlight drive and a keyboard backlight unit, the method comprising:

sensing a background brightness;

setting the portable electronic device to operate at a default mode;

at the default mode, setting the portable electronic device to operate at a daylight mode with a first constant backlight brightness after the sensed background brightness is larger than a first threshold;

at the daylight mode, setting the portable electronic device to operate at the default mode with a second constant backlight brightness after the sensed background brightness is smaller than a second threshold; wherein the first threshold is larger than the second threshold to provide a hysteresis effect, such that a first hysteresis loop is provided in a backlight adjustment curve of the hysteresis-type backlight controlling method to have the portable electronic device operating at the default mode when changing from the default mode to the daylight mode but operating at the daylight mode when changing from the daylight mode back to the default mode as the background brightness is between the first threshold and the second threshold;

at the default mode, setting the portable electronic device to operate at a nighttime mode with a third constant backlight brightness after the sensed background brightness is smaller than a third threshold; and at the nighttime mode, setting the portable electronic device to operate at the default mode with a second constant backlight brightness after the sensed background brightness is larger than a fourth threshold; wherein the fourth threshold is larger than the third threshold to provide the hysteresis effect, such that a second hysteresis loop is provided in the backlight adjustment curve to have the portable electronic device operating at the default mode when changing from the default mode to the nighttime mode but operating at the nighttime mode when changing from the nighttime mode back to the default mode as the background brightness is between the third threshold and the fourth threshold, whereby a rapid mode switch caused by background brightness change is prevented and user dizziness caused by the rapid mode switch is also prevented.

2. The method in claim 1, wherein the first threshold is 2000 lumens and the second threshold is 1000 lumens.

3. The method in claim 1, wherein the third threshold is 100 lumens and the fourth threshold is 150 lumens.

4. The method in claim 1, wherein the LCD is a transreflective LCD.

5. The method in claim 1, wherein the second constant backlight brightness has a maximal brightness for the portable electronic device, the first constant backlight brightness has a minimal brightness for the portable electronic device and the third constant backlight brightness has a 30% brightness of the maximal brightness.

* * * * *